US010813449B2

(12) United States Patent
Wanstall

(10) Patent No.: US 10,813,449 B2
(45) Date of Patent: Oct. 27, 2020

(54) WORKSTATION

(71) Applicant: BAE Systems plc, London (GB)

(72) Inventor: Samuel Paul Wanstall, Preston (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 16/474,089

(22) PCT Filed: Jan. 2, 2018

(86) PCT No.: PCT/GB2018/050001
§ 371 (c)(1),
(2) Date: Jun. 27, 2019

(87) PCT Pub. No.: WO2018/127686
PCT Pub. Date: Jul. 12, 2018

(65) Prior Publication Data

US 2019/0328131 A1 Oct. 31, 2019

(30) Foreign Application Priority Data

Jan. 6, 2017 (EP) ..... 17150511
Jan. 6, 2017 (GB) ..... 700178.5

(51) Int. Cl.
*A47B 21/02* (2006.01)
*A47B 21/03* (2006.01)
*A47B 83/00* (2006.01)

(52) U.S. Cl.
CPC ..... *A47B 21/02* (2013.01); *A47B 21/03* (2013.01); *A47B 83/001* (2013.01); *A47B 2083/006* (2013.01); *A47B 2200/0078* (2013.01)

(58) Field of Classification Search
CPC ..... A47B 21/02; A47B 21/03; A47B 83/001; A47B 2083/006; A47B 2200/0078; A47B 2200/0066; A47B 2021/0076; A47B 21/00
(Continued)

(56) References Cited

U.S. PATENT DOCUMENTS 4,856,749 A * 8/1989 Habermann ..... A47B 97/04 248/448
5,725,192 A * 3/1998 Cloninger ..... A47B 97/04 248/447
(Continued)

FOREIGN PATENT DOCUMENTS

CN 202891146 U 4/2013
CN 204970097 U 1/2016
(Continued)

OTHER PUBLICATIONS

International Preliminary Report on Patentability for Appl No. PCT/GB2018/050001 dated Jul. 9, 2019, 9 pages.
(Continued)

*Primary Examiner* — Jose V Chen
(74) *Attorney, Agent, or Firm* — Maine Cernota & Rardin

(57) ABSTRACT

A workstation comprising a chassis having a base frame (10) and a monitor frame assembly (11), said base frame (10) defining a work area (20) at its proximal end for accommodating a user therein, in use, wherein a desk unit (24) is mounted laterally across said work area and provides a work surface for use by a user accommodated in said work area (20), in use, said monitor frame assembly (11) comprising an outer frame, extending laterally across said base frame (10) and upwardly from its distal end, and an inner frame (32) mounted within said outer frame and configured to receive thereon a plurality of monitor brackets (45), wherein said desk unit (24) is longitudinally adjustable relative to said
(Continued)

base frame (10) so as to selectively adjust its distance from the monitor frame assembly (11), and said inner frame (32) is vertically adjustable within, and relative to, said outer frame so as to selectively adjust its height relative to said base frame; and further wherein respective locking means are provided to releasably lock said desk unit and said inner frame in a selected position.

19 Claims, 4 Drawing Sheets

(58) Field of Classification Search
USPC ..... 108/50.02, 50.01; 248/917–920
See application file for complete search history.

(56) References Cited

U.S. PATENT DOCUMENTS

| | | | | |
|---|---|---|---|---|
| 5,944,896 | A * | 8/1999 | Landesman | B05B 13/0285 118/500 |
| 6,471,174 | B2 * | 10/2002 | Turner | A47B 97/04 248/444 |
| 7,195,213 | B2 * | 3/2007 | Weatherly | A47B 81/061 248/124.1 |
| 7,717,377 | B1 * | 5/2010 | Corrado | G10G 5/00 248/150 |
| 8,662,605 | B2 * | 3/2014 | McRorie | B62B 3/02 108/38 |
| 9,179,493 | B1 * | 11/2015 | Uttley | B62B 1/208 |
| D750,908 | S * | 3/2016 | Hickman | D6/300 |
| 9,475,514 | B2 * | 10/2016 | Hardy | A61B 50/13 |
| 9,723,919 | B1 * | 8/2017 | Randolph | A47B 3/00 |
| 9,918,550 | B1 * | 3/2018 | Taylor | G06F 3/1431 |
| 9,998,706 | B2 * | 6/2018 | Ijams | G09F 9/3026 |
| 10,376,158 | B2 * | 8/2019 | Desroches | A47B 11/00 |
| 2005/0275322 | A1 * | 12/2005 | Mosel | A47B 9/20 312/312 |
| 2006/0249649 | A1 * | 11/2006 | Volk | A47B 21/00 700/213 |
| 2009/0133609 | A1 | 5/2009 | Nethken | |
| 2011/0233350 | A1 * | 9/2011 | Burgess | F16M 11/24 248/123.11 |
| 2012/0031310 | A1 | 2/2012 | Jedrysik et al. | |
| 2014/0245932 | A1 | 9/2014 | McKenzie, III | |

FOREIGN PATENT DOCUMENTS

| | | | |
|---|---|---|---|
| DE | 202004016614 | U | 12/2004 |
| EP | 2166170 | A1 | 3/2010 |
| KR | 20030019925 | A | 3/2003 |
| WO | 9713431 | A1 | 4/1997 |
| WO | 9903376 | A1 | 1/1999 |
| WO | 03/037140 | A1 | 5/2003 |

OTHER PUBLICATIONS

PCT Search Report for Appl No. PCT/GB2018/050001 dated Jan. 25, 2018, 14 pages.

European Search Report frp Appl No. 17150511.8 dated May 22, 2017, 8 pages.

Great Britain Search Report for Appl No. GB1700178.5 dated May 17, 2017, 5 pages.

* cited by examiner

WORKSTATION

RELATED APPLICATIONS

This application is a national phase application filed under 35 USC § 371 of PCT Application No. PCT/GB2018/050001 with an International filing date of 2 Jan. 2018 which claims priority of GB Patent Application 1700178.5 filed 6 Jan. 2017 and EP Patent Application 17150511.8, filed 6 Jan. 2017. Each of these applications is herein incorporated by reference in their entirety for all purposes.

FIELD

This invention relates generally to a workstation for providing an operator work space incorporating a work surface and one or more computer monitors and/or display screens mounted for viewing by an operative.

BACKGROUND

It is conventional practice, in many different environments, to provide individual workstations for operatives. Such workstations are usually required to provide the operative with a work surface or desk space behind which they can sit or stand, and at least one computer monitor or display screen mounted for viewing by the operative.

However, such workstations tend to have a structure that is fixed, or has limited adaptability, such that there is little or no opportunity for an individual user to configure or reconfigure their own work space to meet their specific needs and requirements. Conventional workstations offer little flexibility as to the number and size of screens/monitors that can be accommodated, or indeed their position/orientation relative to the user when positioned behind their work surface. Furthermore, little or no provision is made, in conventional workstations, for differences in body space dimensions of potential workstation users, nor do they facilitate the selective configuration of the workstation to ensure that the user can access all required interfaces as and how they desire.

It would, therefore, be desirable to provide a workstation that provides the flexibility to change the configuration of screens and their position/orientation, as well the height of the various elements, including the desk space and the screens. It would also be desirable to provide a versatile, adaptable workstation that is easily and conveniently portable. Still further, it would be desirable to provide an adaptable workstation configured to carry touch screen monitors, wherein the rigidity of the mounting arrangement is such that it does not flex and, therefore, the monitor does not move when interacted with.

SUMMARY

It is an object of aspects of the present invention to address at least some of these issues and, in accordance with a first aspect of the present invention, there is provided a workstation comprising a chassis having a base frame and a monitor frame assembly, said base frame defining a work area at its proximal end for accommodating a user therein, in use, wherein a desk unit is mounted laterally across said work area and provides a work surface for use by a user accommodated in said work area, in use, said monitor frame assembly comprising an outer frame, extending laterally across said base frame and upwardly from its distal end, and an inner frame mounted within said outer frame and configured to receive thereon a plurality of monitor brackets, wherein said desk unit is longitudinally adjustable relative to said base frame so as to selectively adjust its distance from the monitor frame assembly, and said inner frame is vertically adjustable within, and relative to, said outer frame so as to selectively adjust its height relative to said base frame; and further wherein respective locking means are provided to releasably lock said desk unit and said inner frame in a selected position.

The base frame may, optionally, comprise a pair of elongate, parallel, spaced-apart side bars defining its side edges with a rear bar connected therebetween at their distal ends, an a support bar spanning said side bars at a location intermediate their distal and proximal ends, the proximal ends of said side bars defining an opening therebetween; said work area being defined between said opening and said support bar.

In an exemplary embodiment, the desk unit may comprise a planar desk member having opposing upper and lower planar surfaces, and wherein connectors are coupled to said lower surface, said connectors being slidably mounted in or on respective mounting members provided on said base frame for selective adjustment of the height of said desk member relative to said base frame. Optionally, each connector may comprise a post and each mounting member comprises an upright, generally tubular bar coupled to a respective side edge of the base frame and extending generally vertically upwardly therefrom, each tubular bar being open at its upper end and defining a longitudinal channel therethrough for receiving a respective post for slidable engagement therein. The mounting members may, for example, be formed of extruded aluminium having profiled inner and outer surfaces. It will be known to a person skilled in the art that extruded aluminium bars are formed with longitudinal tracks on their outer surfaces and corresponding longitudinal ridges on their inner surfaces. If the posts are also formed of extruded aluminium, the desired slidable engagement may be achieved by inserting the posts into the channels defined in the mounting members such that the ridges inside the channel engage with corresponding tracks on the outer surface of a respective post, and the post can slide up and down along the track as required.

Each mounting member may be slidably coupled to a respective side edge of the base frame for longitudinal adjustment of its respective position thereon, the desk member being mounted on said base frame by said connectors provided on its lower surface coupled to respective mounting members such that, in use, said desk is longitudinally adjustable relative to said base frame by sliding said mounting members to a desired position along the length of the side edge of said base frame adjacent said work area. Once again, if the side edges of the base frame are defined by extruded aluminium bars for example, then longitudinal tracks will be provided in their outer surface. Each mounting member may comprise a protrusion or ridge that enables it to be coupled to a respective bar by insertion thereof into a track such that the mounting member can slide back and forth along the bar as required.

The desk unit may comprise a planar desk member pivotally mounted laterally across, and vertically spaced apart from, said base frame to allow selective adjustment of the angular orientation about a lateral axis thereof, and a locking member is provided to releasably lock said desk member at a desired angular orientation.

The workstation may further comprise a footrest mounted laterally between side edges of said base frame within said work area, said footrest being longitudinally adjustable relative to said base frame so as to selectively adjust its relative location within said work area. The footrest may, optionally, comprise a planar footplate having a longitudinal axis that laterally spans said base frame, said footrest being pivotally mounted for selective adjustment of the angular orientation about said longitudinal axis thereof, and a locking member is provided to releasably lock said footplate at a desired angular orientation.

In an exemplary embodiment, the inner frame may be slidably mounted at opposing side edges thereof between a pair of parallel, vertical, spaced-apart side arms forming said outer frame, for slidable adjustment of the height of said inner frame relative to said base frame.

The outer frame may comprise a pair of parallel, vertical, spaced apart side arms, each side arm defining a longitudinal track in a surface thereof, and each side edge of said inner frame comprises a longitudinal ridge configured to be slidably received in a respective track. Once again, if the inner and outer frames are formed of extruded aluminium, then the required tracks and ridges are naturally formed for the desired operation.

The inner frame may comprise a generally square or rectangular frame member having a generally central, cross-shaped intersecting member therein to define four, generally square or rectangular openings. Optionally, the inner side edges of said intersecting member may be configured to have coupled thereto one or more monitor brackets. The intersecting member may comprise, along its inner side edges, a longitudinal track configured to receive a locking member configured to be coupled to an angle bracket of a monitor bracket. Thus, as before, if the intersecting member is formed of extruded aluminium, the tracks formed during the extrusion process can be used for this purpose.

Thus, in an exemplary embodiment, the base frame, the outer frame and the inner frame are formed of extruded aluminium bars coupled by interlocking connectors.

The workstation may be provided with a wheel or castor adjacent each corner of the base frame to enable said workstation to be manually conveyed thereon. Thus, each individual workstation can be made fully portable.

These and other aspects of the present invention will be apparent from the following specific description, in which embodiments of the present invention will be described, by way of examples only, and with reference to the accompanying drawings, in which:

DETAILED DESCRIPTION

Figure 1:
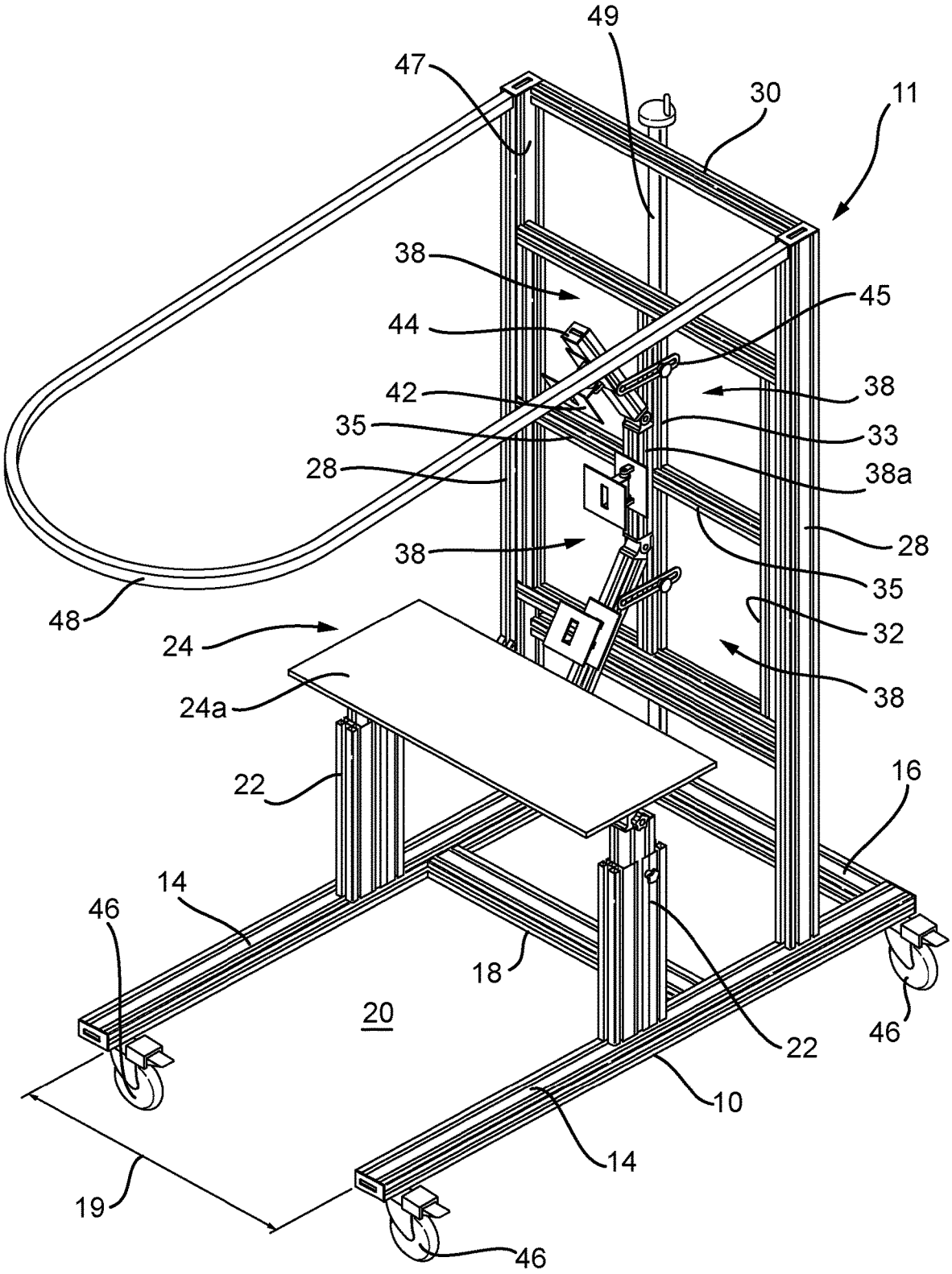
FIG. 1 is a schematic perspective view of a portable workstation according to a first exemplary embodiment of the present invention.

Referring to FIG. 1 of the drawings, a portable workstation according to a first exemplary embodiment of the present invention comprises a chassis formed of a base frame 10 and a monitor frame assembly 11. The base frame 10 comprises a pair of parallel, spaced-apart, extruded aluminium side bars 14, coupled by interlocking connectors at their distal ends by a rear bar 16 therebetween. The proximal ends of the side bars 14 define a space 19 therebetween, wide enough to accommodate an operative's chair. A support bar 18 extends, substantially parallel to the rear bar 16, between the side bars 14 at a location intermediate their distal and proximal ends, such that an operative work area 20 is defined between the space 19 and the support bar 18.

An extruded aluminium upright mount 22 is provided on each side bar 14, each upright mount 22 extending upwardly, at substantially 90 degrees, from its respective side bar 14 at a location near the distal end of the work area 20 (i.e. nearest the support bar 18). Each mount 22 comprises a generally rectangular, extruded aluminium bar defining a longitudinal (vertical) channel through at least a portion of its length and being open at its upper end. A desk assembly 24, comprising a generally rectangular, planar work surface 24*a* having opposing upper and lower surfaces, is provided, the lower surface of the work surface 24*a* having a pair of longitudinally opposed posts 26 extending downwardly therefrom, at substantially 90 degrees thereto. The work surface 24*a* is mounted on the workstation by means of the posts 26 (FIG. 2), each of which is slidably received within the channel defined by a respective upright mount 22, such that the relative height of the work surface 24*a* can be selectively adjusted by sliding the posts upward and downward within the channels. Means are provided for fixing the posts within the channels at a selected desk height. Each post 26 is coupled to the lower surface of work surface 24*a* by means of an adjustable link bracket (not shown), which enables the relative angle of the work surface 24*a* to be adjusted, as required, by pivoting the planar work surface 24*a* about its horizontal axis. Once again, means (not shown) are provided to lock the work surface 24*a* in a desired angular orientation.

The monitor frame assembly 11 comprises an outer frame defined by first and second elongate side arms 28, each side arm 28 extending upwardly, at substantially 90 degrees, from a respective side bar 14 of the base frame 10, at a location intermediate its distal end and the support bar 18. A top bar 30 extends between the upper ends of the side arms 28, connecting them by means of interlocking connection means (not shown). The monitor frame assembly 11 further comprises an inner frame 32, mounted within the outer frame, between the two side arms 28. A bracing strut 34 (FIG. 2) extends at an angle between each side bar 14 and a respective side arm 28 of the outer frame, to strengthen the overall structure.

The inner frame 32 comprises a generally square frame, with a first, vertical bar 33 extending generally centrally between its upper and lower edges, and a pair of second, horizontal bars 35 extending generally centrally between the vertical bar 33 and a respective side edge of the frame, so as to form a generally central cross-shaped structure within the square frame, defining four equally-sized square openings 38 therein. At least the inner side edges of each of the openings 38 is provided with a longitudinal track 38*a* configured to receive a clamping member therein such that it can be slidably adjusted along, and selectively locked within, the track 38*a*. A monitor mounting bracket 40 comprises a connector plate 42 coupled to a support member 44, the connector plate 42 being configured to fixedly receive a monitor or screen, and the support member 44 being coupled to the above-mentioned clamping member via an angle bracket 45 or the like, such that the angular orientation of the monitor carried on the connector plate 42 can be selectively adjusted, and its height can be adjusted (via the clamping member).

The inner frame 32 is mounted, via its side edges, within tracks 47 in the inner side edges of the side arms 28 of the outer frame, such that the inner frame 32 is slidable along their length for selective adjustment of its relative height. In the exemplary embodiment illustrated in FIG. 1 of the drawings, a generally central, vertical rear support bar 49 is mounted at the distal end of the base frame 10 and the inner frame is slidably coupled thereto at its rear so as to provide further structural support for the inner frame 32, in use.

Lockable castors 46 are provided at the distal and proximal ends of the two side bars 14 defining the base frame 10, to enable the assembly to be conveniently transported to a desired location.

In the exemplary embodiment illustrated in FIG. 1 of the drawings, a generally U-shaped rail 48 extends generally horizontally across the workstation, with its free ends being coupled to the upper end of respective side arms 28, and the curved end terminating at a location approximately in line with the space 19. The rail 48 may be configured to carry a curtain or screen member to provide the user, in use, with privacy and/or noise reduction.

Figure 2:
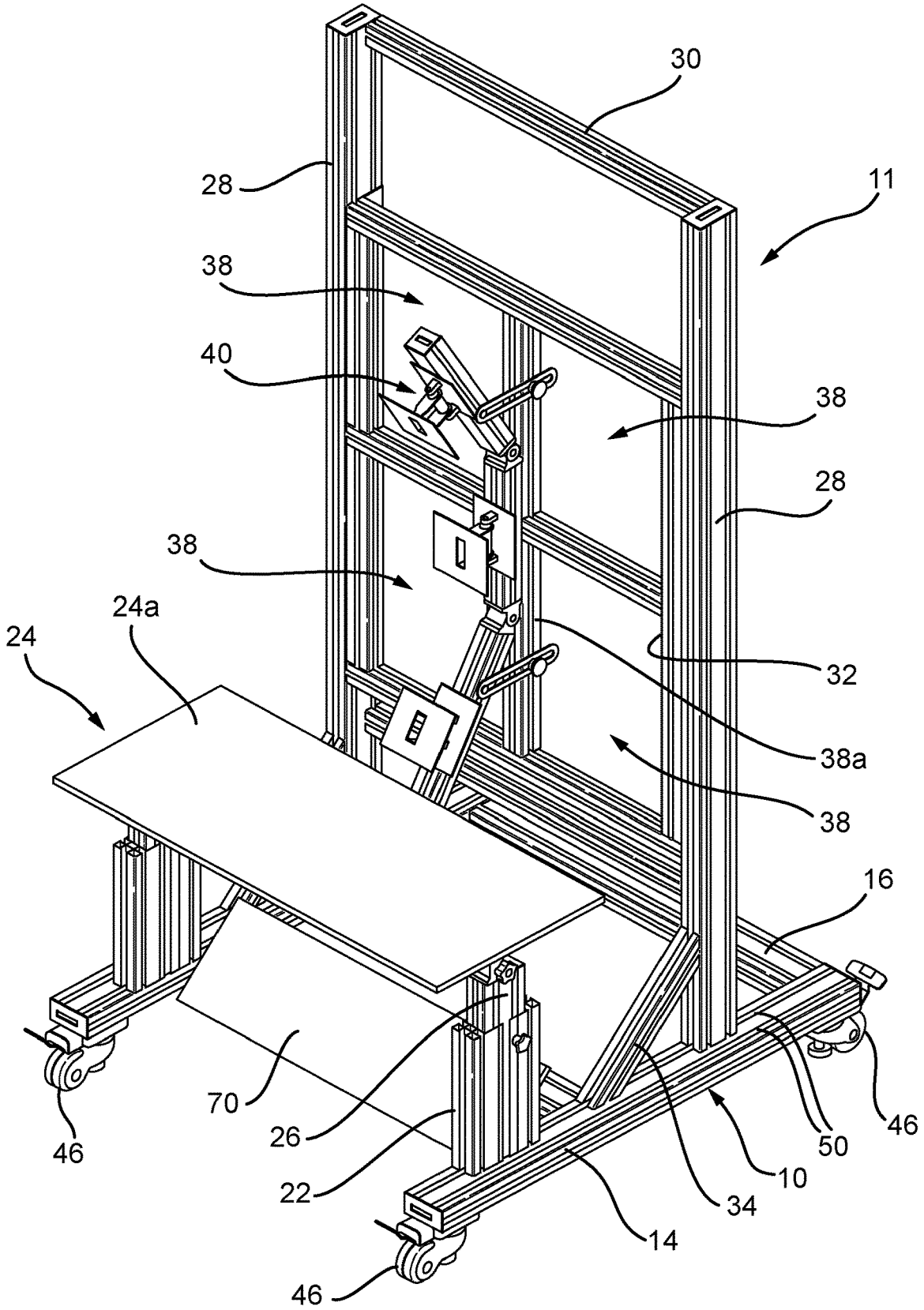
FIG. 2 is a schematic perspective view of a portable workstation according to a second exemplary embodiment of the present invention.

Referring now to FIG. 2 of the drawings, a workstation according to a second exemplary embodiment of the present invention is similar in many respects to the workstation described above, and like components and elements are denoted by the same reference numerals.

Thus, the illustrated workstation comprises a base frame 10 and a monitor frame assembly 11 of a configuration substantially as hereinbefore described. The upper surface of each side bar 14 of the base frame 10 is profiled to define at least one longitudinal track 50 or (as in this case) a pair of parallel longitudinal tracks. Each upright mount 22 is mounted for slidable movement within a track 50 in a respective side bar 14 such that the distance of the desk assembly 24 from the space 19 can be selectively adjusted, and a clamping member (not shown) may be provided to lock the desk assembly 24 in a desired position.

Figure 3:
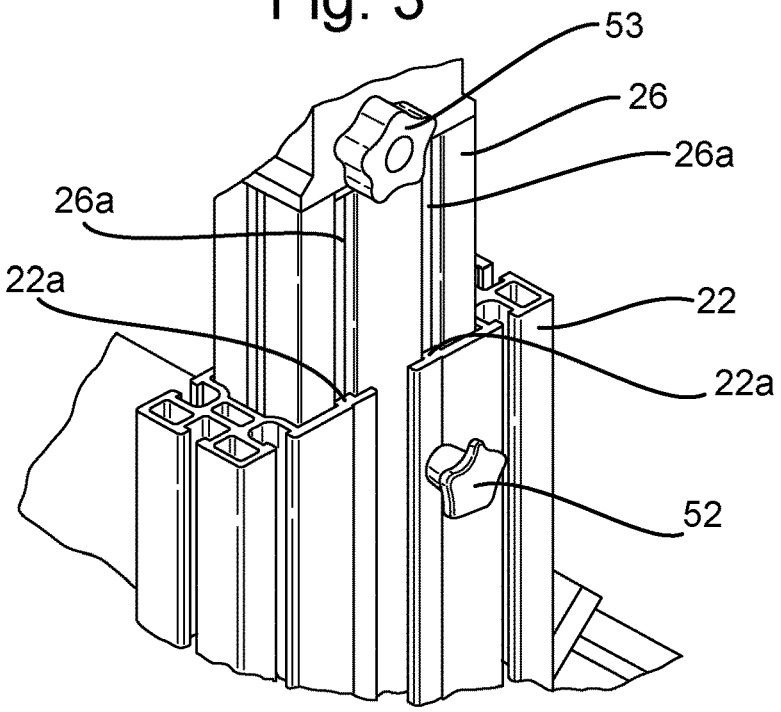
FIG. 3 is a schematic partial view of a height adjustment mechanism incorporated in the portable workstation of FIG. 2.

As shown more clearly in FIG. 3 of the drawings, each post 26 extending from the rear of the work surface 24*a* defines a pair of longitudinal tracks 26*a* and is slidably coupled within a channel defined in a respective upright mount 22 by means of cooperative parallel ridges 22*a* provided on the inner side wall of the channel, which are received within respective tracks 26*a* in the post to allow slidable vertical movement of the posts 26 within the upright mount channels. The height of the work surface 24*a* can thereby be selectively adjusted and a clamping knob 52 is provided to lock the work surface 24*a* at a desired height (relative to the ground). As before, the posts 26 are coupled to the lower surface of the work surface 24*a* by means of adjustable link brackets (not shown) to enable the angular orientation (relative to a horizontal plane) to be adjusted as required by the user, and locked in a desired angular orientation by a clamping knob 53.

Thus, the work surface 24*a* can be selectively adjusted in three different ways or axes according to a user's preference and body space dimensions: 1) distance of the work surface from the monitor(s) mounted on the monitor frame assembly 11; 2) height of the work surface (from the floor); and 3) angular orientation of the work surface 24*a* (relative to a horizontal plane). This level of adjustability and versatility is considered to be highly advantageous in comparison to individual workstations currently known in the art.

Referring back to FIG. 2 of the drawings, the inner side surface of each of the side arms 28 is provided with a pair of parallel, longitudinal tracks 28 that run along its length, as before. The inner frame 32 is provided with a corresponding pair of parallel longitudinal ridges which are received within respective tracks 28*a* so as to slidably mount the inner frame between the side arms 28. Thus the relative height of the inner frame 32 can be slidably adjusted, and a clamping member (not shown) is provided to lock the inner frame 32 at a desired height.

Figure 4:
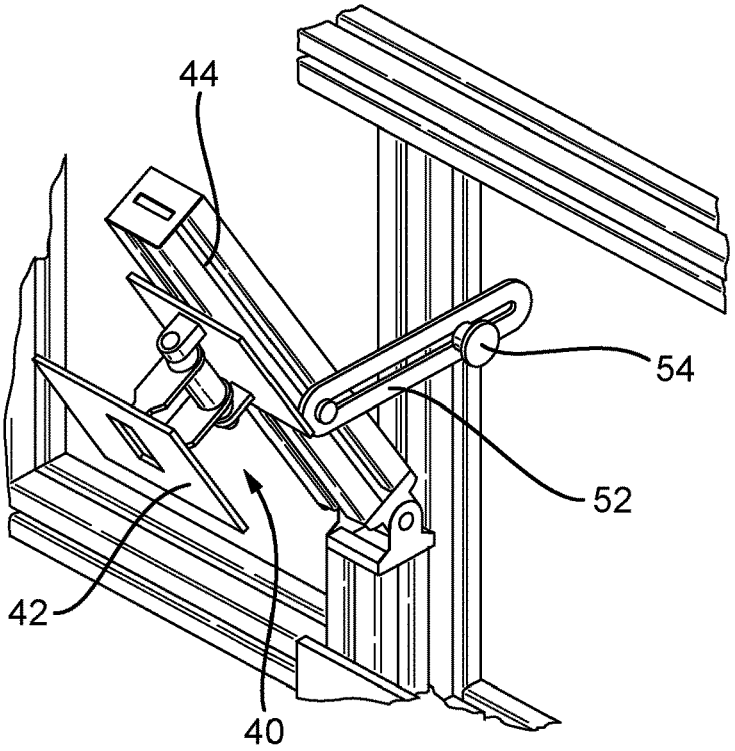
FIG. 4 is a schematic partial view of a monitor bracket incorporated in the portable workstation of FIG. 2.

Referring additionally to FIG. 4 of the drawings, each monitor mounting bracket 40 comprises a connector plate 42 coupled to an elongate support member 44. The connector plate 42 is configured to fixedly receive a monitor or screen (not shown). The support member 44 is removably coupled to an inner side edge of any of the bars forming the inner frame 32 via an angle bracket 52 coupled to a clamping knob 54 recessed in a respective track, and slidably therealong when the clamping knob 54 is released. The angle bracket 52 enables the angular orientation of the connector plate 42 (and, therefore, the screen/monitor held thereon) to be selectively adjusted and the clamping knob 54, when tightened, locks the monitor/screen in the desired angular orientation and location along a respective track. Thus, the location on the monitor frame assembly, the height and the angular orientation of the screen/monitor (or multiple screens/monitors) can be selected and adjusted as required.

A footrest 70 is mounted, by means of adjustable link brackets (not shown) between the side bars 14 of the base frame 10 at a location intermediate their proximal ends and the support bar 18. The angular orientation and/or its position within the work area 20 may be selectively adjusted by a user, according to their requirements, and then locked in the desired configuration by clamping means (not shown).

A back panel (not shown) may be provided over the rear plane of the outer frame in some embodiments, to hide cabling etc.

Figure 5:
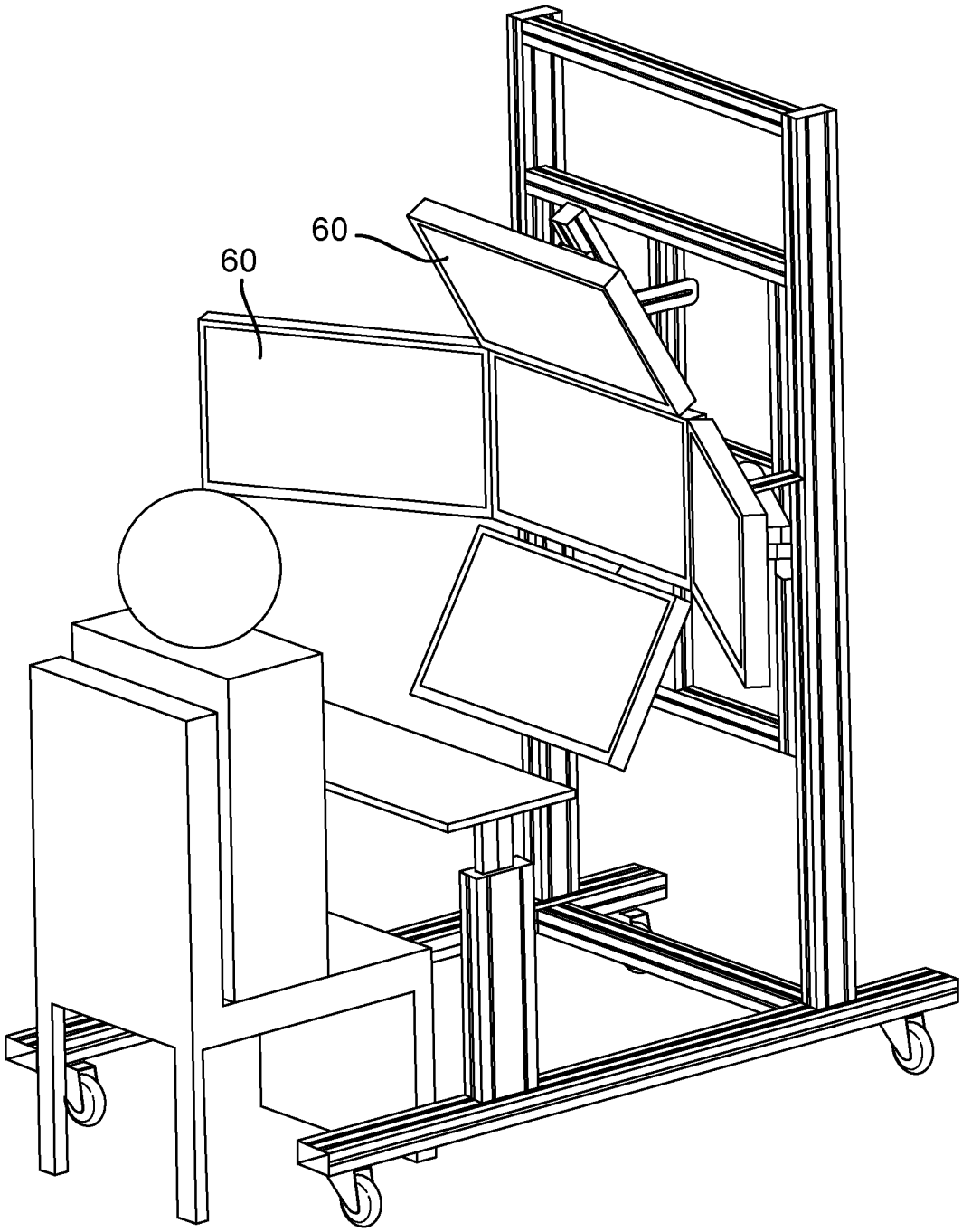
FIG. 5 is a schematic diagram illustrating a portable workstation according to an exemplary embodiment of the present invention, when in use.

It will be appreciated, therefore, that a workstation according to an exemplary embodiment of the present invention provides unprecedented versatility in terms of height/relative position of the work surface and the location, height and angular orientation of multiple monitors. Indeed, further versatility is provided in terms of the number of screens/monitors, and their relative configuration, that can be supported. Thus, referring to FIG. 5 of the drawings, for example, an arrangement of five monitors 60 can be seen, with a central monitor being surrounded, on each of its sides, by a respective further monitor. In the example shown, the central monitor, which is substantially at eye level with the user when positioned as shown in the work area 20, is substantially vertical, whereas each of the peripheral monitors is angled outward from the inner frame to optimise the user's viewing angle in respect thereof. More generally, the exemplary workstations illustrated can support up to six 24" (e.g. touch screen) monitors in various mounting positions, and up to two 32" (e.g. touch screen) monitors in various configurations.

Thus, exemplary embodiments of the present invention provide a workstation that is designed to be a flexible and adaptable workspace which can be quickly and easily reconfigured depending on the required scenario. It can utilise off-the-shelf aluminium profile to provide a large range od adjustability. Heavy duty locking castors may be utilised to enable ease of movement over various terrains (e.g. from laboratory floors to bumpy car parks). The workstation user has the ability to adjust the desk height and angle, the foot rest distance and angle, along with the height and depth of the monitors or screens. The screen mounts may, for example, be designs to allow fitment of up to 6 24" touch screen monitors in various mounting positions, as well as up to two 32" touch screen monitors, again in various configurations. The desk top or work surface may be designed to be large enough to hold one keyboard, one mouse and the user's notepad. Holders for the user's headset and drinks cup may also be provided on the outer frame, for example. The rigidity of the workstation is considered to be a significant improvement over prior art solutions, which compromise the use of touchscreens by allowing monitors to move under the pressure of being touched. The vast adjustability of all components within a workstation according to the above-described embodiments is not available in prior art arrangements.

The above-described workstation utilises extruded aluminium profiles and interlocking connectors to form the chassis, to which locking castor wheels and monitor mounts are attached. By using the extruded profile, a large range of adjustment is available to the user by loosening the locking members and sliding the element to be adjusted along its profile track, although other means to achieve the same result may also be utilised and the present invention is not necessarily intended to be limited in this regard.

In one exemplary embodiment, it is thought that the desk height might be adjustable between 660 mm and 770 mm (upper surface) (BS7179), and desk depth may be a minimum of 400 mm (assuming that the desk needs to accommodate a keyboard and other elements). Sufficient seat adjustment could be provided to allow a $5^{th}$ percentile of female (sitting eye height 685 mm) and a $95^{th}$ percentile male (sitting eye height 845 mm) to view the screen(s) from the same eye position. Thus, the adjustment range may be 160 mm. Ideally, a main display will have a preferred viewing angle of 15 degrees from horizontal line of sight at a viewing distance of at least 500 mm. Touch panels may have a 45 degree viewing angle. An upper display should, ideally, be located as close to the one below it as possible and is likely to have the same viewing angle but reversed. Touch panels and other controls can all be located within a convenient reach zone, with frequently operated controls placed within a zone of convenient reach and infrequently used controls placed in a normal work area, relative to a user.

It will be apparent to a person skilled in the art, from the foregoing description, that modifications and variations can be made to the described embodiments without departing from the scope of the present invention as defined by the appended claims. For example, it is considered that the principal advantages of the workstation provided by aspects of the invention are associated with the large number of degrees of freedom that the general structure provides in terms of adjustability of the various elements and the configurability of the monitors or screens carried thereon. This versatility is advantageously provided in the described embodiments by utilising extruded aluminium bars and interlocking connectors to form the workstation chassis, such that the extruded profile can be utilised to provide the desired slidable movement of the upright mounts, the footrest, and the inner frame, as well as the monitor brackets, when mounted on the inner frame. However, it will be appreciated by a person skilled in the art that other coupling means may be utilised similarly effectively to achieve a similar result. Furthermore, whilst specific locking members in the form of clamping knobs have been utilised in the described embodiments, it will be appreciated by a person skilled in the art that other releasable locking mechanisms could alternatively be utilised.

What is claimed is:

1. A workstation comprising:

a chassis having a base frame; and a monitor frame assembly;

said base frame defining a work area at its proximal end for accommodating a user therein, in use;

wherein a desk unit is mounted laterally across said work area and provides a work surface for use by a user accommodated in said work area, in use;

said monitor frame assembly comprising:

an outer frame, extending laterally across said base frame and upwardly from its distal end; and an inner frame mounted within said outer frame and configured to receive thereon a plurality of monitor brackets, wherein said inner frame comprises:

a generally square or rectangular frame member having a generally central, cross-shaped intersecting member therein to define four, generally square or rectangular openings;

wherein said desk unit is longitudinally adjustable relative to said base frame so as to selectively adjust its distance from the monitor frame assembly; and said inner frame is vertically adjustable within, and relative to, said outer frame so as to selectively adjust its height relative to said base frame; and further wherein respective locks are provided to releasably lock said desk unit and said inner frame in a selected position.

2. The workstation according to claim 1, wherein said base frame comprises:

a pair of elongate, parallel, spaced-apart side bars defining its side edges;

a rear bar connected therebetween said side bars at said distal ends; and a support bar spanning said side bars at a location intermediate their distal and proximal ends, the proximal ends of said side bars defining an opening therebetween;

said work area being defined between said opening and said support bar.

3. The workstation according to claim 1, wherein said desk unit comprises:

a planar desk member having opposing upper and lower planar surfaces; and wherein connectors are coupled to said lower surface, said connectors being slidably mounted in or on respective mounting members provided on said base frame for selective adjustment of the height of said desk member relative to said base frame.

4. The workstation according to claim 3, wherein each connector comprises:

a post; and each mounting member comprises:

an upright, generally tubular bar coupled to a respective side edge of the base frame and extending generally vertically upwardly therefrom, each tubular bar being open at its upper end and defining a longitudinal channel therethrough for receiving a respective post for slidable engagement therein.

5. The workstation according to claim 3, wherein:

each mounting member is slidably coupled to a respective side edge of the base frame for longitudinal adjustment of its respective position thereon;

the desk member being mounted on said base frame by said connectors provided on the lower surface coupled to respective mounting members such that, in use, said desk is longitudinally adjustable relative to said base frame by sliding said mounting members to a desired position along the length of the side edge of said base frame adjacent said work area.

6. The workstation according to claim 1, wherein said desk unit comprises:

a planar desk member pivotally mounted laterally across, and vertically spaced apart from, said base frame to allow selective adjustment of the angular orientation about a lateral axis thereof; and a locking member is provided to releasably lock said desk member at a desired angular orientation.

7. The workstation according to claim 1, further comprising:

a footrest mounted laterally between side edges of said base frame within said work area;

said footrest being longitudinally adjustable relative to said base frame so as to selectively adjust its relative location within said work area.

8. The workstation according to claim 7, wherein said footrest comprises:

a planar footplate having a longitudinal axis that laterally spans said base frame;

said footrest being pivotally mounted for selective adjustment of the angular orientation about said longitudinal axis thereof; and a locking member provided to releasably lock said footplate at a desired angular orientation.

9. The workstation according to claim 1, wherein said inner frame is slidably mounted at opposing side edges thereof between a pair of parallel, spaced-apart side arms forming said outer frame, for slidable adjustment of the height of said inner frame relative to said base frame.

10. The workstation according to claim 1, wherein said outer frame comprises:

a pair of parallel, spaced apart side arms, each side arm defining a longitudinal track in a surface thereof; and each side edge of said inner frame comprises a longitudinal ridge configured to be slidably received in a respective track.

11. The workstation according to claim 1, wherein inner side edges of said intersecting member are configured to have coupled thereto one or more monitor brackets.

12. The workstation according to claim 11, wherein said intersecting member comprises:

along the inner side edges, a longitudinal track configured to receive a locking member configured to be coupled to an angle bracket of a monitor bracket.

13. The workstation according to claim 1, wherein said base frame, said outer frame and said inner frame are formed of extruded aluminium bars coupled by interlocking connectors.

14. The workstation according to claim 1, comprising a wheel or castor adjacent each corner of said base frame to enable said workstation to be manually conveyed thereon.

15. The workstation according to claim 1, wherein said inner frame comprises:

a left vertical inner frame member;

a right vertical inner frame member;

a lower horizontal inner frame member affixed between lower ends of said left vertical inner frame member and said right vertical inner frame member;

an upper horizontal inner frame member affixed between upper ends of said left vertical inner frame member and said right vertical inner frame member;

wherein said cross-shaped intersecting member of said inner frame comprises:

a vertical cross-bar affixed between said upper horizontal inner frame member and said lower horizontal inner frame member; and a pair of horizontal cross-bars affixed between said left vertical inner frame member and said vertical cross-bar, and between said vertical cross-bar and said right vertical inner frame member.

16. The workstation according to claim 1, comprising:

at least one track defined by a frame member whereby a mount is slidably mounted for slidable movement.

17. The workstation according to claim 1, comprising:

one pair of desk/monitor/foot side bar supports.

18. The workstation according to claim 1, comprising:

a privacy curtain rail.

19. A workstation comprising:

a chassis having a base frame; and a monitor frame assembly;

said base frame defining a work area at its proximal end for accommodating a user therein, in use;

wherein a desk unit is mounted laterally across said work area and provides a work surface for use by a user accommodated in said work area, in use;

said monitor frame assembly comprising:

an outer frame, extending laterally across said base frame and upwardly from its distal end; and an inner frame mounted within said outer frame and configured to receive thereon a plurality of monitor brackets, wherein said inner frame comprises:

a generally square or rectangular frame member having a generally central, cross-shaped intersecting member therein to define four, generally square or rectangular openings;

wherein said inner frame further comprises:

a left vertical inner frame member;

a right vertical inner frame member;

a lower horizontal inner frame member affixed between lower ends of said left vertical inner frame member and said right vertical inner frame member;

an upper horizontal inner frame member affixed between upper ends of said left vertical inner frame member and said right vertical inner frame member;

wherein said cross-shaped intersecting member of said inner frame comprises:

a vertical cross-bar affixed between said upper horizontal inner frame member and said lower horizontal inner frame member; and a pair of horizontal cross-bars affixed between said left vertical inner frame member and said vertical cross-bar, and between said vertical cross-bar and said right vertical inner frame member;

said inner frame is vertically adjustable within, and relative to, said outer frame so as to selectively adjust its height relative to said base frame;

at least one track defined by a frame member whereby a mount is slidably mounted for slidable movement;

one pair of desk/monitor/foot side bar supports; and a privacy curtain rail;

wherein said desk unit is longitudinally adjustable relative to said base frame so as to selectively adjust its distance from the monitor frame assembly; and further wherein respective locks are provided to releasably lock said desk unit and said inner frame in a selected position.

* * * * *